US005096134A

United States Patent [19]

Sakano

[11] Patent Number: 5,096,134

[45] Date of Patent: Mar. 17, 1992

[54] DEVICE FOR UNROLLING AND CUTTING LEADING END PORTION OF STRIP-LIKE MATERIAL WOUND IN ROLL

[75] Inventor: Makoto Sakano, Tokyo, Japan

[73] Assignee: Japan Tobacco Inc., Tokyo, Japan

[21] Appl. No.: 513,964

[22] Filed: Apr. 24, 1990

[30] Foreign Application Priority Data

Apr. 26, 1989 [JP] Japan ..... 1-104626

[51] Int. Cl.[5] ..... B65H 19/18

[52] U.S. Cl. ..... 242/57; 242/78.8; 242/55; 242/58; 226/92

[58] Field of Search ..... 242/58.1, 58.5, 78.8, 242/57, 58, 58.4, 55; 226/92

[56] References Cited

U.S. PATENT DOCUMENTS 4,721,263 1/1988 Miyazaki ..... 242/78.8
4,840,320 6/1989 Shigeta et al. ..... 242/78.8
4,848,691 7/1989 Muto et al. ..... 242/58.1
4,984,750 1/1991 Shigeta et al. ..... 242/58.1

*Primary Examiner*—Daniel P. Stodola
*Assistant Examiner*—John Q. Nguyen
*Attorney, Agent, or Firm*—Nixon & Vanderhye

[57] ABSTRACT

A device for unrolling a leading end portion of a strip-like material from a roll formed by winding the strip-like material and cutting a predetermined portion of the leading end portion is disclosed. A chuck head is arranged below the roll loaded on a loading shaft. The chuck head is supported by a parallel link mechanism to be movable while keeping its horizontal position. The chuck head is moved upward to peel the leading end portion of the strip-like material from the peripheral surface of the roll. The strip-like material is unrolled by base and pinch feed rollers. A predetermined portion of the leading end portion of the drawn strip-like material is cut by a cutter unit. The cut unnecessary portion of the leading end portion of the strip-like material is exhausted.

4 Claims, 9 Drawing Sheets

DEVICE FOR UNROLLING AND CUTTING LEADING END PORTION OF STRIP-LIKE MATERIAL WOUND IN ROLL

BACKGROUND OF THE INVENTION

1. Field of the Invention

The present invention relates to a device for peeling and unrolling a leading end portion of a strip-like material wound in a roll shape, e.g., strip-like wrapping paper for wrapping cigarettes, and cutting an unnecessary portion of the leading end portion of the strip-like material to form a new leading end.

2. Description of the Related Art

As a conventional device of this type, a device disclosed in Published Unexamined Japanese Utility Model Application No. 61-125298 is known.

This device is designed for a roll of strip-like paper having a leading end portion adhered to the roll.

This device comprises a chuck arranged below the roll. The chuck comprises a peeling lever, and a pawl segment incorporating with the peeling lever. The pawl segment is pivotally supported on the peeling lever through a pin, and is opened/closed to approach/separate from the peeling lever by an air cylinder mechanism and a return spring. The chuck can pick up the leading end portion of the strip-like paper of the roll to peel it from the roll as a free end portion, thereby allowing an unrolling operation of the strip-like paper from this roll.

A proximal end portion of the peeling lever is pivotally supported. The peeling lever approaches/separates from the peripheral surface of the roll when it is pivoted. The distal end of the peeling lever is formed sharp so as to pick up and peel the leading end portion of the strip-like paper from the peripheral surface of the roll. The sharp distal end of the peeling lever is brought into contact with the peripheral surface of the roll at a predetermined angle with respect to a tangential direction of the roll, thereby peeling the leading end portion of the strip-like paper adhered to the peripheral surface. However, when the diameter of the roll changes, the distal end portion of the peeling lever which is in contact with the peripheral surface of the roll may often fail to keep a precise predetermined angle with respect to the tangential direction of the peripheral surface of the roll. In this case, the sharp distal end portion of the peeling lever projects into the peripheral surface of the roll, and its operation is disturbed. In addition, the distal end portion may damage a portion of the strip-like paper wound in the roll.

A portion from the leading end portion of the strip-like paper wound in the roll by a certain length cannot be normally used due to contamination, damage, or the like. Such an unusable unnecessary portion which cannot be used must be cut and removed. In order to remove the unusable unnecessary portion, the device comprises a cutter unit. In a known device, a suction roller is arranged below a roll. The leading end portion of the strip-like paper which is peeled from the peripheral surface of the roller by the chuck as a free end is drawn by suction by the suction roller, and is fed to the cutter unit. In the conventional known device, however, the structure and operation of a mechanism for feeding the free leading end portion of the strip-like paper to the cutter unit are complex, and reliability of an operation is not assured.

SUMMARY OF THE INVENTION

It is an object of the present invention to eliminate the drawbacks of the conventional device described above. It is another object of the present invention to provide a device which can reliably peel a leading end portion of a strip-like material from a roll as a free end without damaging the strip-like material wound in the roll.

The objects of the present invention can be attained by the following arrangement.

The device of the present invention comprises a horizontal loading shaft on which a roll is loaded. A chuck head is arranged below the roll loaded on the loading shaft. A horizontal stationary chuck pawl projects from this chuck head, and a movable chuck pawl is arranged below the stationary chuck pawl. The distal end portion of the stationary chuck pawl is formed sharp. The distal end portion is brought into contact with the peripheral surface of the roll to peel the leading end portion of a strip-like material from the peripheral surface.

The chuck head is supported by a horizontal link mechanism, and is vertically moved by a lift mechanism. Therefore, the chuck head is vertically moved while its horizontal position is left unchanged. Thus, an angle defined between the distal end portion of the stationary chuck pawl projecting from this chuck head and the peripheral surface of the roll is always constant. The strip-like material can be reliably peeled from the peripheral surface of the roll without damaging the strip-like material wound in the roll with the sharp distal end portion of the stationary chuck pawl.

A base feed roller and a pinch feed roller are arranged below the roll. The pinch feed roller can approach/separate from the base feed roller.

The leading end portion of the strip-like material peeled from the peripheral surface of the roll by the chuck pawl is clamped between these feed rollers, and is guided along a predetermined guide path. A predetermined portion of the leading end portion of the strip-like material is cut by a cutter unit, and the cut unnecessary portion is removed, thus forming a new leading end of this strip-like material.

According to the device of the present invention, the chuck head is moved upward, the distal end of the stationary chuck pawl is brought into contact with the peripheral surface of the roll, and the leading end portion of the strip-like material is peeled from the peripheral surface of the roll. In this case, since the chuck head is supported and guided by the parallel link mechanism, it can be moved upward while maintaining its predetermined position. Therefore, even when the diameter of the roll changes, an angle defined between the distal end of the stationary chuck pawl and the roll is constant, and the peeling operation of the leading end of the strip-like material can be reliably executed. In addition, the strip-like material wound in the roll can be prevented from being damaged by the sharp distal end of the stationary chuck pawl.

The leading end portion of the strip-like material peeled from the peripheral surface of the roll is clamped between the stationary and movable chuck pawls, and is unrolled when the chuck head is moved downward, thereby forming a free leading end portion. The leading end portion of the strip-like material is clamped between the base and pinch feed rollers, and is unrolled upon rotation of these rollers. The strip-like material is then fed along a predetermined guide path. A predetermined portion of the leading end portion of the strip-like material is cut by the cutter unit, thus forming a new leading end of the strip-like material. The cut unnecessary portion is exhausted through an exhaust guide.

The device of the present invention can assure a reliable operation, and has a simple structure.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENT

A leading end unrolling/cutting device for a strip-like material according to an embodiment of the present invention will now be described with reference to the accompanying drawings.

Figure 1:
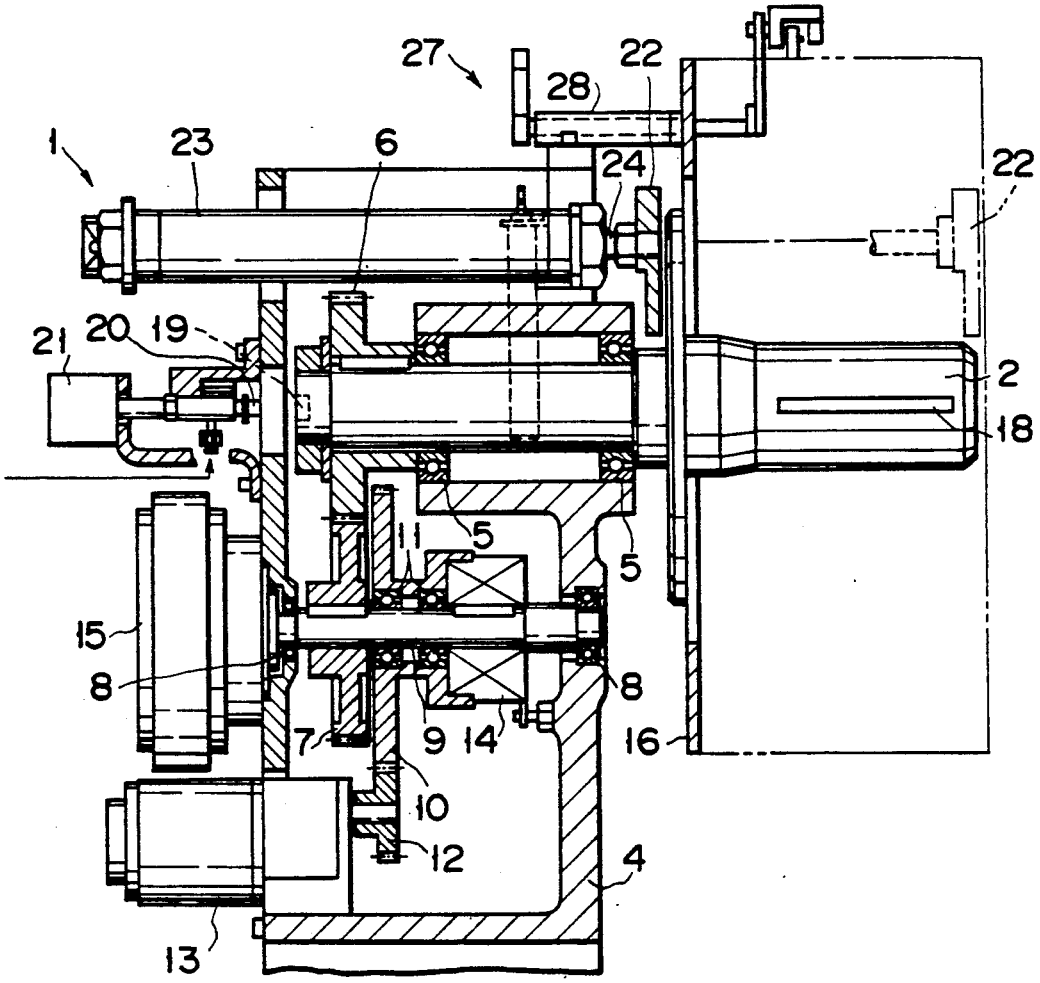
FIG. 1 is a sectional view showing an upper portion of a device of the present invention.

A device according to this embodiment is for a wrapping material A for forming soft packages of cigarettes as a strip-like material, and its upper portion is shown in FIG. 1.

The device comprises a horizontal first loading shaft 2 and a horizontal second loading shaft (not shown) rotatably supported on a base frame 4. Rolls R formed by winding wrapping materials A can be loaded on these loading shafts.

Figure 2:
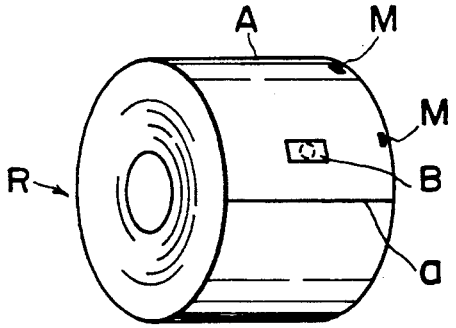
FIG. 2 is a perspective view of a roll.
Figure 3:
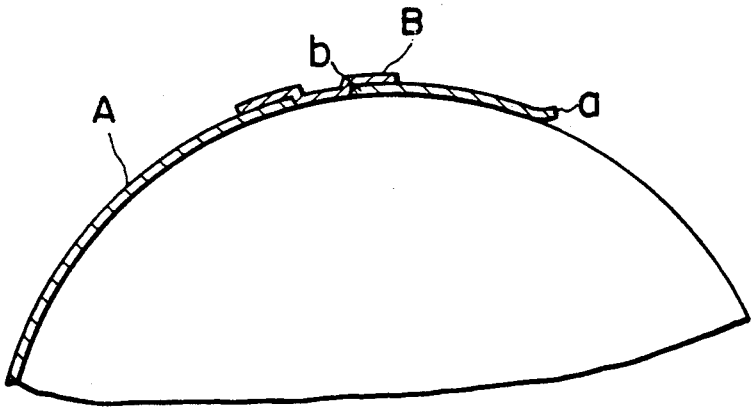
FIG. 3 is a partial sectional view of the roll.

In the roll R, as shown in FIGS. 2 and 3, the leading end portion of the wrapping material A is fixed at a position separated by a predetermined length from its leading end a by an adhesive tape B. More specifically, a circular hole b is formed at the center of the leading end portion of the wrapping material A to be separated from the leading end a by a predetermined distance, and the adhesive tape B is attached to close this hole. Thus, the leading end portion of the wrapping material A is fixed to the outer peripheral surface of the roll R. The adhesive tape B comprises an aluminum tape. An end indication tape (not shown) for indicating the trailing end of the wrapping material A is adhered to the wrapping material A of the roll R at a position separated from the trailing end by a predetermined distance. The end indication tape also comprises an aluminum tape as in the adhesive tape B, and is adhered to the central portion of the wrapping material A. Furthermore, register marks M are printed on one side edge of the wrapping material A at equal intervals in the longitudinal direction of the wrapping material A. The register marks M are formed at an interval corresponding to a length of the wrapping material A required for one soft package.

Loading mechanisms for loading the rolls R to the loading shafts, and their driving mechanisms are respectively the same, and the loading and driving mechanisms for only the first loading shaft 2 will be described below with reference to FIG. 1.

The first loading shaft 2 is rotatably supported on a base frame 4 through a pair of bearings 5. One end portion of the first loading shaft 2, which extends from the base frame 4, constitutes an actual loading portion of the roll R. On the other hand, a gear 6 is mounted on the other end portion of the first loading shaft 2, which extends inside the base frame 4. The gear 6 is meshed with a gear 7. The gear 7 is mounted on a rotating shaft 9 rotatably supported on the base frame 4 through a pair of bearings 8. The rotating shaft 9 is parallel to the first loading shaft 2. Furthermore, a gear 10 is rotatably mounted on the rotating shaft 9 through a pair of bearings 11 at a position adjacent to the gear 7. The gear 10 is meshed with a driving gear 12. The driving gear 12 is mounted on the output shaft of a reversible electric motor 13. The electric motor 13 is supported on the base frame 4.

A clutch 14 is mounted on the rotating shaft 9. The clutch 14 has a function of engaging/disengaging a rotational driving force to be transmitted from the driving gear 12 to the rotating shaft 9 through the gear 10. Therefore, when the clutch 14 is engaged, the first loading shaft 2 can be rotated by the electric motor 13 through the driving gear 12, the gear 10, the clutch 14, the rotating shaft 9, and the gears 7 and 6.

A powder brake 15 supported on the base frame 4 is mounted on the rotating shaft 9. The powder brake 15 has a function of giving a predetermined braking force to the rotating shaft 9 to prevent an excessive tension from acting on the wrapping material A unrolled from the roll R as the diameter of the roll R is decreased.

Figure 4:
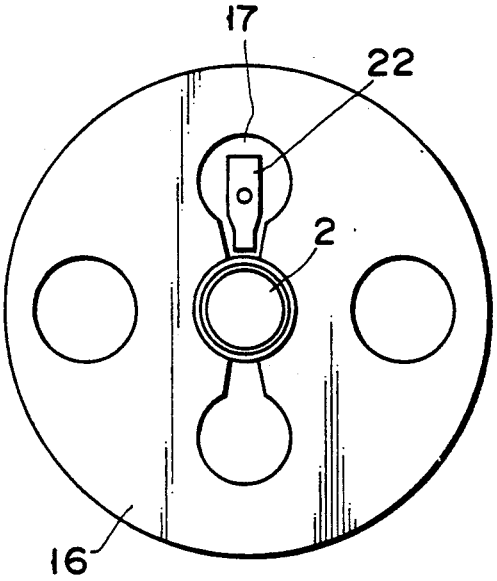
FIG. 4 is a front view of a back plate.

A back plate 16 for the roll R is attached to the loading portion of the first loading shaft 2. A pair of through holes 17 are formed in the back plate 16, as shown in FIGS. 1 and 4. Four locking lugs 18, for example, are retractably mounted on the peripheral surface of the loading portion of the first loading shaft 2 at equal angular intervals in the circumferential direction. These locking lugs 18 are held while projecting from the peripheral surface of the loading portion by compressed air. More specifically, an injection port 19 with a valve for introducing compressed air into the first loading shaft 2 is formed in the other end face of the first loading shaft 2, and an injection nozzle 20 is arranged on the other end side of the first loading shaft 2 to face the injection port 19. The injection nozzle 20 is connected to a compressed air source (not shown), and can approach/separate from the injection port 19 of the first loading shaft 2 by an air cylinder 21.

Therefore, while the roll R is attached to the loading portion of the first loading shaft 2, the air cylinder 21 is expanded to connect the injection nozzle 20 to the injection port 19, and the valve is opened, thereby supplying compressed air to the interior of the first loading shaft 2. Thus, the locking lugs 18 of the first loading shaft 2 project, and are urged against the inner peripheral surface of the roll R. As a result, the roll R can be attached to and held by the loading portion of the first loading shaft 2.

In order to detach the roll R, in practice, a core (not shown) of the roll R from the first loading shaft 2 after the wrapping material A of the roll R is used up, a release pusher 22 which can pass through each through hole 17 of the back plate 16 is used. More specifically, the release pusher 22 is located between the back plate 16 and the base frame 4 at a rest position illustrated in FIG. 1, and is mounted on the distal end of a piston rod 24 of an air cylinder 23. Note that the air cylinder 23 is supported by the base frame 4.

Therefore, after the pressing forces of the locking lugs 18 of the first loading shaft 2 are released, the air cylinder 23 is expanded to push out the release pusher 22, as indicated by an imaginary line in FIG. 1, thereby detaching the core of the roll R from the first loading shaft 2.

Figure 5:
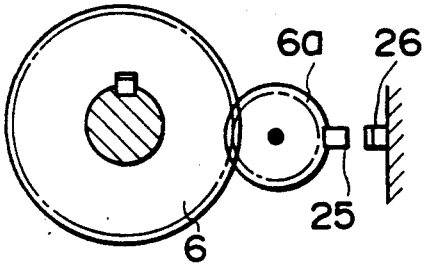
FIG. 5 is a view showing an arrangement of gears in a roll driving device.

As can be apparent from the above description, when the roll R is detached from the first loading shaft 2, the corresponding through hole 17 of the back plate 16 must be aligned with the release pusher 22. This alignment can be attained by detecting a rotational angle of the first loading shaft 2. More specifically, in order to detect the rotational angle of the first loading shaft 2, as shown in FIG. 5, a rotational angle detection gear 6*a* is meshed with the gear 6 of the first loading shaft 2. The gear 6*a* is rotated once per half a rotation of the gear 6. A timing plate 25 is mounted on the gear 6*a*, and a sensor 26 for detecting passage of the timing plate 25 is fixed near the gear 6*a*. Therefore, the mounting position of the timing plate 25 with respect to the gear 6*a* can be set at a position corresponding to one through hole 17 of the back plate 16. Thus, when rotation of the first loading shaft 2 is stopped upon reception of a detection signal from the sensor 26, the through hole 17 of the back plate 16 can be aligned with the release pusher 22.

The sensor 26 can comprise a proximity sensor or a photosensor. The detection signal from the sensor 26 can be used not only to detect the rotational angle of the first loading shaft 2 but also to detect the current diameter of the roll R which is decreased as the wrapping material A is unrolled by counting the number of detection signals.

Figure 6:
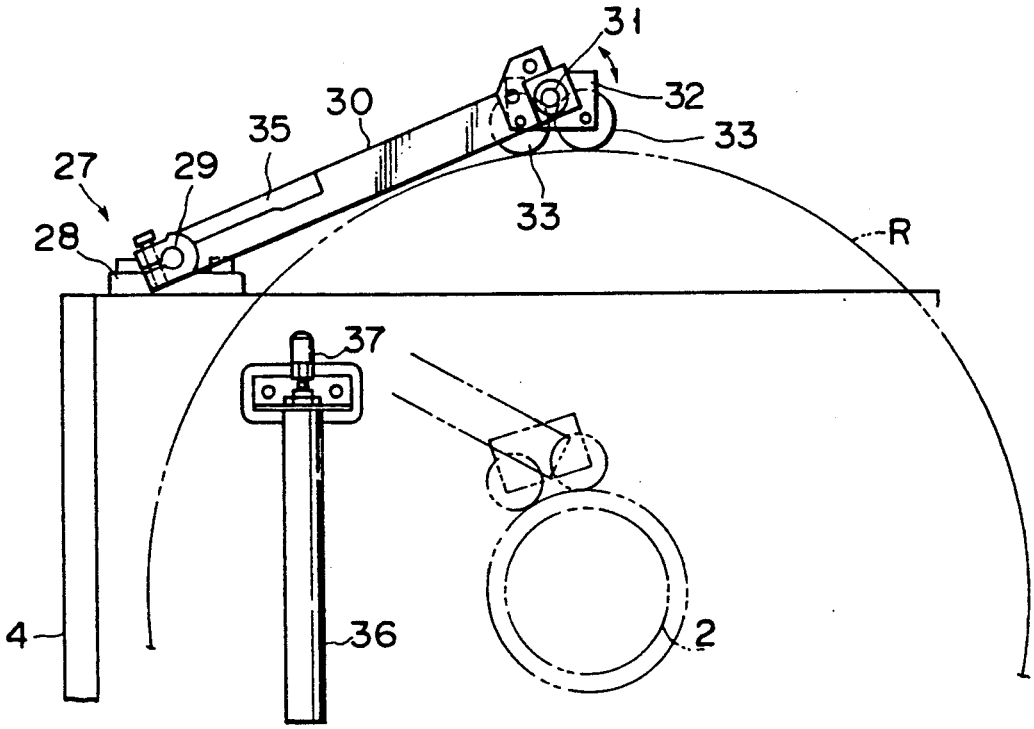
FIG. 6 is a side view of a detection device.
Figure 7:
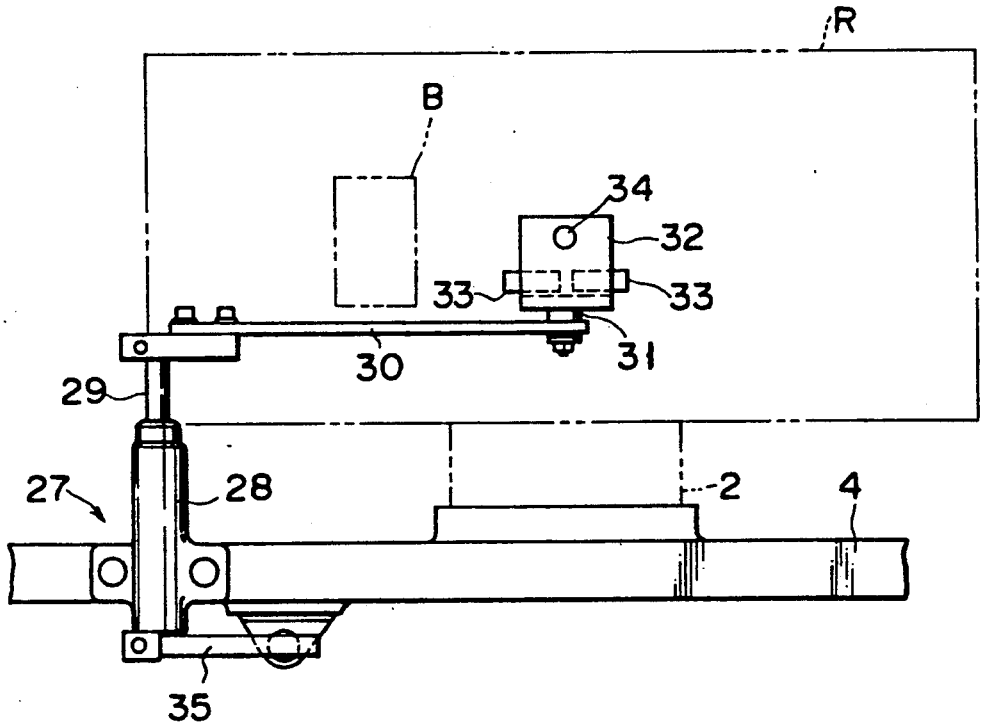
FIG. 7 is a plan view of the detection device.

Referring to FIGS. 6 and 7 in addition to FIG. 1, a detection device 27 for detecting the adhesive tape B and the end indication tape of the roll R while the roll R is loaded on the first loading shaft 2 is disposed on the upper portion of the device.

The detection device 27 comprises a pivot shaft 29 mounted on the upper end of the base frame 4 through a bearing base 28. As can be seen from FIG. 6, the pivot shaft 29 is located outside the roll R, and extends to be parallel to the first loading shaft 2.

One end of the pivot shaft 29 projecting toward the roll R extends to overlap the peripheral surface of the roll R when viewed in the vertical direction. A pivot arm 30 is mounted on this end. A roller carrier 32 is pivotally arranged on the distal end portion of the pivot arm 30 through a support pin 31. A pair of rollers 33 which can be brought into rolling contact with the peripheral surface of the roll R are rotatably mounted on the roller carrier 32. These rollers 33 are mounted to be separated from the axis of the support pin 31 by the same distance in the circumferential direction of the roll R. A photosensor 34 is arranged on the roller carrier 32 to be located above the central portion of the peripheral surface of the roll R and along the axis of the support pin 31. The photosensor 34 outputs a detection signal when the adhesive tape B or the end indication tape of the roll R passes below the photosensor 34.

The other end of the pivot shaft 29 projects in the base frame 4. A release arm 35 for the pivot arm 30 is mounted on this end. As can be apparent from FIG. 7, the release arm 35 extends to be parallel to the pivot arm 30 in the same direction. An air cylinder 36 stands upright on the base frame 4 to be located below the release arm 35. A pusher 37 which can be engaged with the release arm 35 is mounted on the distal end of the piston rod of the air cylinder 36.

According to the detection device 27 described above, when the roll R is loaded on the first loading shaft 2, the air cylinder 36 is expanded, and the release arm (lever) 35, e.g., the pivot arm (lever) 30 is pivoted upward by the pusher 37 to a position where it does not disturb loading of the roll R. In this state, the roll R is loaded on the first loading shaft 2, and thereafter, the air cylinder 36 is contracted, as shown in FIG. 6. Thus, the pivot arm 30 is pivoted downward by its weight, and, hence, the pair of rollers 33 of the roller carrier 32 are brought into rolling contact with the peripheral surface of the roll R.

When the core of the roll R is removed from the first loading shaft 2, the pivot lever 30 is pivoted upward in the same manner as described above. Although not shown, the same detection device as the detection device 27 described above is equipped at the side of the roll R loaded on the second loading shaft 3.

Figure 8:
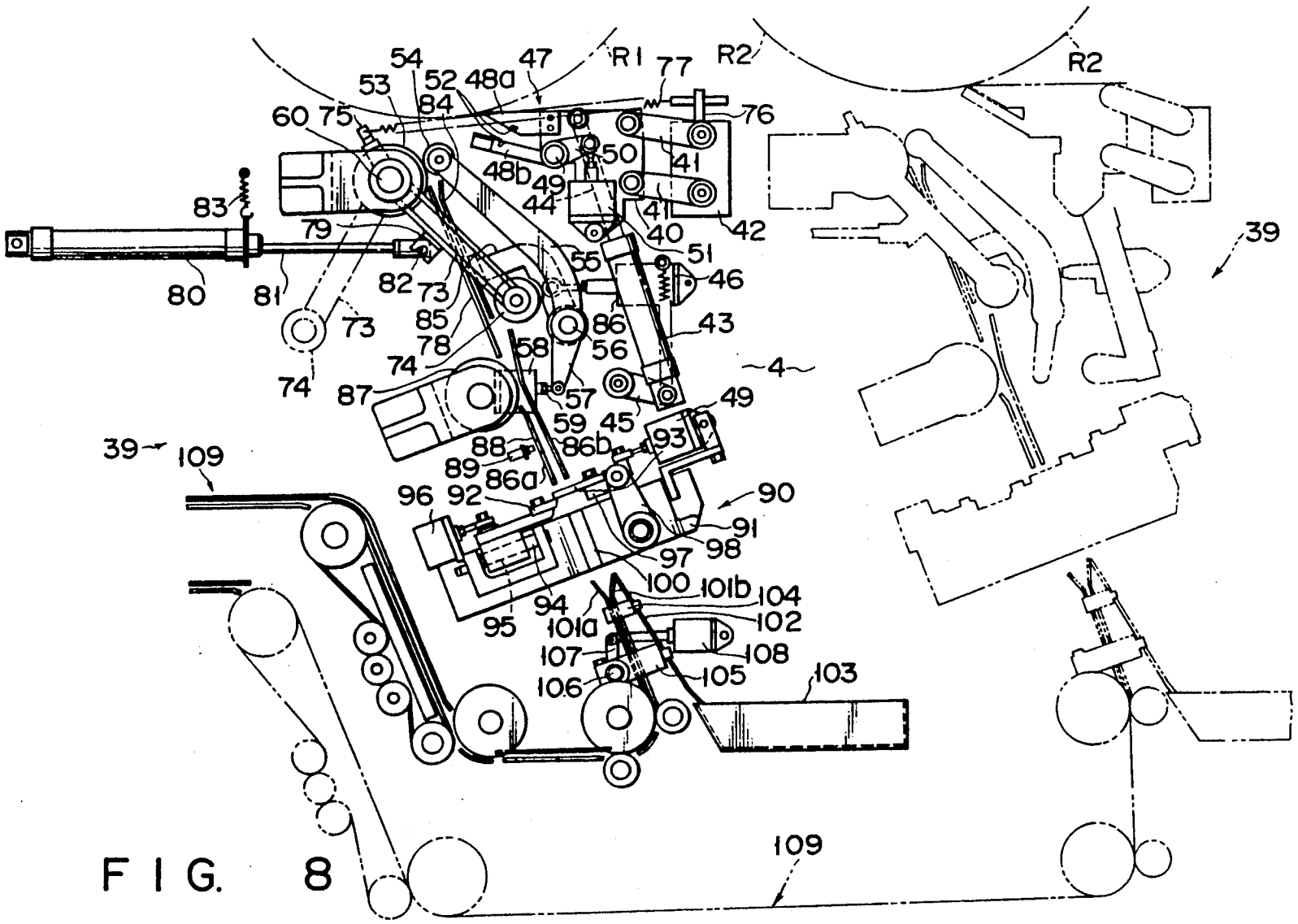
FIG. 8 is a side view of a cutting/unrolling unit.

A pair of cutting/unrolling units 39 paired with the rolls are disposed below first and second rolls R1 and R2 respectively loaded on the loading shafts, as shown in FIG. 8. These cutting/unrolling units 39 have the same structure. Thus, FIG. 8 shows in detail only the cutting/unrolling unit 39 paired with the first roll R1 of the first loading shaft 2.

In the cutting/unrolling unit 39, a chuck head 40 is disposed below the first roll R1. The chuck head 40 is mounted on a support block 42 through a pair of parallel links 41 as a parallel link mechanism. The chuck head 40 is supported by an air cylinder constituting a portion of a lift mechanism, i.e., a lift cylinder 43. More specifically, the chuck head 40 is pivotally supported on the distal end of a piston rod 44 of the lift cylinder 43, and the lift cylinder 43 is supported on the base frame 4 through a link 45. A compression coil spring 46 extends between the link 45 and the base frame 4. The lift cylinder 43, i.e., the chuck head 40 is biased upward by a predetermined force by the compression coil spring 46.

A chuck 47 is mounted on the chuck head 40. The chuck 47 comprises a stationary chuck pawl 48*a* extending in the tangential direction of the first roll R1, and a movable chuck pawl 48*b* located below the stationary chuck pawl 48*a*. The stationary chuck pawl 48*a* has an upper surface contiguous from the upper surface of the chuck head 40, as shown in FIG. 8, and its distal end portion is tapered toward the distal end. On the other hand, the proximal end portion of the movable chuck pawl 48*b* is pivotally mounted on the chuck head 40 through a chuck shaft 49. A link 50 extending in a direction opposite to the extending direction of the movable chuck pawl 48*b* is mounted on the chuck shaft 49. The link 50 is coupled to a piston rod of an opening/closing cylinder 51 comprising an air cylinder. The opening/closing cylinder 51 is mounted on the chuck head 40. Therefore, the movable chuck pawl 48*b* is pivoted by expanding/contracting the opening/closing cylinder 51, thereby opening/closing this movable chuck pawl 48*b*, i.e., the chuck 47. Furthermore, photosensors 52 constituting a first detector are mounted on the stationary and movable chuck pawls 48*a* and 48*b*. Each photosensor 52 a light-emitting element and a light-receiving element which are arranged to oppose each other.

Therefore, according to the above-mentioned arrangement, when the lift cylinder 43 is contracted, the chuck head 40, i.e., the chuck 47 can be moved to approach/separate from the first roll R1. In this case, since the chuck head 40 is moved upward/downward through the pair of parallel links 41, the chuck 47, i.e., the stationary chuck pawl 48*a* is parallelly moved in the vertical direction. As a result, when the chuck 47 is brought into contact with the peripheral surface of the first roll R1, the stationary chuck pawl 48*a* will not project into the peripheral surface of the first roll R1 and damage the wrapping material A.

The lift cylinder 43 is supported on the base frame 4 through the link 45, and is biased upward by the compression coil spring 46, as described above. Therefore, if the diameter of the first roll R1 before the wrapping material A is unrolled, i.e., of a new first roll R1 slightly varies, the stationary chuck pawl 48*a* can be urged against the peripheral surface of the first roll R1 at a constant pressure. Thus, this can also reliably prevent the stationary chuck pawl 48*a* from projecting into the outer peripheral surface of the first roll R1.

A base feed roller 53 is rotatably arranged in front of the chuck 47, i.e., the stationary and movable chuck pawls 48*a* and 48*b*, to be located near the peripheral surface of the first roll R1. A pair of pinch feed rollers 54 (FIG. 9) are arranged near the chuck 47. Each pinch feed roller 54 is supported by an opening/closing mechanism. More specifically, the opening/closing mechanism comprises a pivot lever 55 which extends vertically in correspondence with the pinch feed roller 54.

Each pinch feed roller 54 is mounted on the upper end of the corresponding pivot lever 55. The lower end of each pivot lever 55 is mounted on a pivot shaft 56. Furthermore, the pivot shaft 56 is rotatably supported by the base frame 4. A link 57 extending downward is mounted on the pivot shaft 56. The lower end of the link 57 is coupled to a piston rod 59 of an air cylinder 58. Therefore, when the air cylinder 58 is expanded/contracted to pivot the pivot levers 55, the pinch feed rollers 54 can approach/separate from the base feed roller 53.

Figure 9:
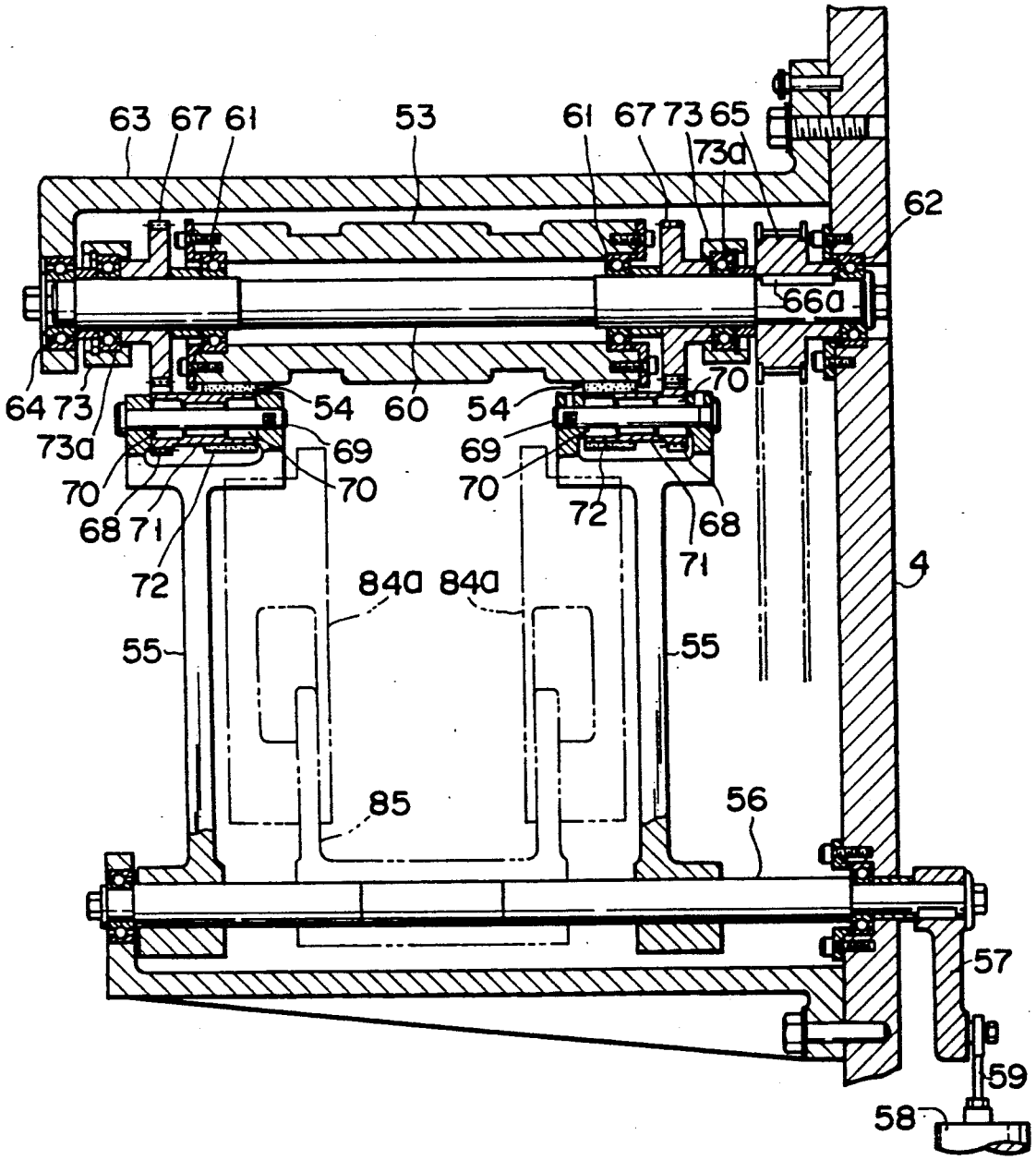
FIG. 9 is a sectional view of feed rollers.

FIG. 9 illustrates in detail the positional relationship between the base feed roller 53 and the pinch feed rollers 54. More specifically, the base feed roller 53 is rotatably mounted on a roller shaft 60 through a pair of bearings 61. One end of the roller shaft 60 is rotatably mounted on the base frame 4 through a bearing 62, and the other end thereof is rotatably supported on a support arm 63 through a bearing 64.

A toothed pulley 65 is mounted on the one end portion of the roller shaft 60 through a key 66*a*. An endless toothed belt 66 is looped on the toothed pulley 65. The toothed belt 66 is looped on a toothed driving pulley (not shown). Thus, when the driving pulley is rotated, the roller shaft 60 is rotated in one direction through the toothed belt 66 and the toothed pulley 65.

A pair of gears 67 are mounted on the roller shaft 60 on the two sides of the base feed roller 53. Meanwhile, each pinch feed roller 54 is equipped with a gear 68 which can be meshed with a corresponding gear 67 when the pinch feed rollers 54 are in rolling contact with the base feed roller 53. The pinch feed rollers 54 will be described below. Each pinch feed roller 54 comprises a rotary sleeve 71 rotatably mounted on the upper end of the corresponding pivot lever 55 through a pair of roller bearings 70, and a roller ring 72 mounted on he rotary sleeve 71 and formed of an elastic material. The above-mentioned gear 68 is attached to the rotary sleeve 71.

Therefore, according to the above-mentioned arrangement, when the pinch feed rollers 54 are in rolling contact with the base feed roller 53 and the roller shaft 60 is rotated, the rotating force is transmitted to the pinch feed rollers 54 through the gears 67 and 68, and the pinch feed rollers 54 are rotated thereby. Note that the base feed roller 53 is rotated upon rotation of the pinch feed rollers 54. When the air cylinder 58 is expanded, the pivot levers 55 are pivoted through the links 57 to separate the corresponding pinch feed rollers 54 from the base feed roller 53. Thus, the gear 67 of the roller 60 and the gears 68 of the pinch feed rollers 54 are disengaged from each other. As a result, the base feed roller 53 and the pinch feed rollers 54 can be freely rotated.

A pair of tension levers 73 are mounted on the two end portions of the roller shaft 60 of the above-mentioned base feed roller 53 via bears 73*a*. FIG. 9 illustrates only mounting portions of the tension levers 73 to the roller shaft 60. As can be seen from FIG. 8, the tension levers 73 extend downward, and a tension roller 74 is rotatably arranged between the lower ends of the tension levers 73. Coupling members 75 for coupling these tension levers 73 project from the upper end portions of the tension levers 73. A tension spring 77 comprising a tensile coil spring extends between the coupling members 75 and the base frame 4, e.g., a projection 76 of the support block 42. The tension spring 77 biases the tension levers 73 clockwise in FIG. 8 by a predetermined force.

Furthermore, a guide plate 78 for the wrapping material A, is mounted to extend between the two tension levers 73. The guide plate 78 is located to extend obliquely downward from the base feed roller 53 while the tension levers 73 are in a state indicated by a solid line, although it is only schematically illustrated in FIG. 8. An engaging bracket 79 is mounted on one tension lever 73 to project in a direction opposite to the pivot lever 55. The engaging bracket 79 can be engaged with an engaging pin 82 mounted on the distal end of a piston rod 81 of an air cylinder 80. More specifically, when the air cylinder 80 is expanded, the engaging pin 82 is engaged with the engaging bracket 79 to be able to pivot the tension levers 73 to a solid line position of FIG. 8. The base portion of the outer cylinder of the air cylinder 80 is pivotally supported on the base frame 4, and the distal end of the outer cylinder is elastically suspended from the base frame 4 through a suspension spring 83. When the air cylinder 80 is contracted, since the engaging pin 82 and the engaging bracket 79 are disengaged from each other, the tension levers 73 and the tension roller 74 can be returned to the position indicated by an imaginary line in FIG. 8 upon reception of the biasing force of the tension spring 77.

A guide plate 84 is arranged near the guide plate 78 to be located at a position opposite to the air cylinder 80. The guide plate 84 extends parallel to the guide plate 78 in a state illustrated in FIG. 8. These guide plates 78 and 84 define a portion of an unrolling path of the wrapping material A therebetween in cooperation with each other. The guide plate 84 comprises a pair of plate pieces 84*a*, as illustrated by imaginary lines in FIG. 9. These plate pieces 84*a* are located to be separated at a predetermined interval in the axial direction of the base feed roller 53. The guide plate 84 is rotatably mounted on the pivot shaft 56 through a pivot lever 85. The pivot lever 85 is coupled to a piston rod of an air cylinder 86. Therefore, upon expansion/contraction of the air cylinder 86, the guide plate 84 can be pivoted through the pivot lever 85 in a direction to approach/separate from the guide plate 78.

A pair of guide plates 86*a* and 86*b* are fixed below the guide plate 78 and 84 to be continuous with these guide plates 78 and 84. A guide roller 87 for the wrapping material A is rotatably arranged between the guide plates 78 and 86*a*, and an opening 88 is formed in the guide plate 86*a*. A sensor 89 is arranged near the opening 88 to oppose it. The sensor 89 outputs a detection signal every time it detects a register mark M of the wrapping material A when the wrapping material A passes a gap between the guide plates 86*a* and 86*b*.

A cutter unit 90 is disposed below the guide plates 86*a* and 86*b*. The cutter unit 90 comprises a cutter block 91 which is fixed to and supported on the base frame 4. A pair of movable cutting blades 92 and 93 which are driven in a direction perpendicular to the above-mentioned guide plates 86*a* and 86*b* are mounted on the cutter block 91. One movable cutting blade 92 is fixed to a carrier 95. The carrier 95 is slidably mounted on a guide rod 94 of the cutter block 91. Reciprocal movement of the carrier 95 is attained by an air cylinder 96. The other movable cutting blade 93 is also mounted on a carrier 97. The carrier 97 is movably arranged on the cutter block 91 through a link 98, and its movement is attained by an air cylinder 99.

A path 100 which is continuous with a path defined between the guide plates 86*a* and 86*b* is formed in the cutter block 91. Therefore, the above-mentioned guide plates 78 and 84, the guide roller 87, the guide plates 86*a* and 86*b*, and the path 100 define a guide path for guiding the unrolling operation of the wrapping material A.

A leading end convey guide for guiding the leading end (to be described later) of the wrapping material A, i.e., a pair of guide plates 100*a* and 101*b* are arranged below the cutter block 91 to be continuous with the path 100. These guide plates 101*a* and 101*b* have the same shapes as those of the guide plates 86*a* and 86*b*. The upper end portions of these guide plates 101*a* and 101*b* are opened to reliably guide the wrapping material A, as shown in FIG. 8. Furthermore, a plate-like exhaust guide 102 is arranged on the pair of guide plates 101*a* and 101*b*, and a dust box 103 is arranged below the exhaust guide 102.

The guide plates 101*a* and 101*b*, and the exhaust guide 102 are supported by a guide switching mechanism. More specifically, the guide switching mechanism comprises coupling members 104 and 105 for coupling the guide plates 101*a* and 101*b*, and the exhaust guide 102. Of these coupling members 104 and 105, the lower coupling member 105 is pivotally supported by a support shaft 106. An arm 107 projects from the coupling member 105, and is coupled to a piston rod of an air cylinder 108. Therefore, according to the guide switching mechanism with the above arrangement, when the air cylinder 108 is expanded or contacted, the guide plates 101*a* and 101*b*, and the exhaust guide 102 can be pivoted about the support shaft 106. As a result, whether the upper ends of the guide plates 101*a* and 101*b* ar connected to the path 100 of the cutter block 91 or the exhaust guide 102 is connected to the path 100 can be selected.

The operation of the cutting/unrolling unit 39 described above will be described below with reference to FIGS. 10 to 16 as well as the drawings referred to in the above description.

Figure 10:
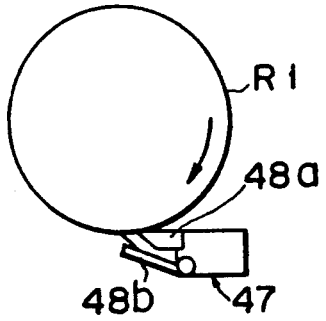
FIGS. 10 to 16 are schematic views sequentially showing operations of the cutting/unrolling unit.
Figure 11:
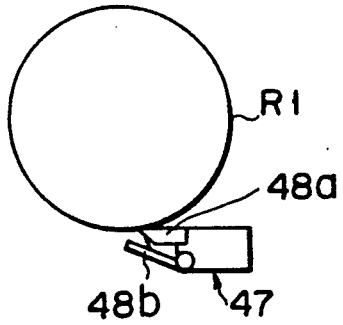
Figure 12:
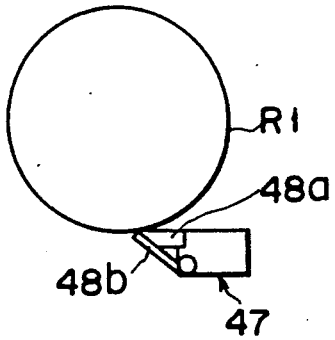
Figure 13:
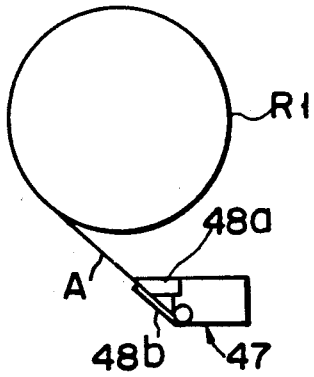

When the first roll R1 is loaded on the first loading shaft 2, the chuck 47 is moved upward in an open state, and as shown in FIG. 10, the stationary chuck pawl 48*a* of the chuck 47 is brought into contact with the peripheral surface of the first roll R1. In this state, the first roll R1 is rotated in a direction of an arrow in FIG. 10. When the adhesive tape B is detected by the photosensor 34 of the detection device 27 during rotation of the first roll R1, the rotation of the first roll R1 is stopped, and the thereafter, the first roll R1 is rotated in a direction opposite to the direction of the arrow. When the first roll R2 is rotated in this direction and the lading end a of the wrapping material A of the first roll R1 reaches the chuck 47, the leading end a of the wrapping material A is picked up by the stationary chuck pawl 48*a*, as shown in FIG. 11. Thus, the leading end portion of the wrapping material A is guided into the chuck 47. In this manner, when the leading end portion of the wrapping material A guided into the chuck 47 passes by the photosensors 52, detection signals are output from the photosensors 52, and at that time, the chuck 47 is closed, as shown in FIG. 12. Thus, the leading end portion of the wrapping material A is clamped by the chuck 47. Thereafter, the chuck 47 is moved downward while clamping the wrapping material A, as shown in FIG. 13. As a result, the adhesive tape B of the first roll R1 is peeled, and the leading end portion of the wrapping material A is set in a free state, so that the wrapping material A can be unrolled from the first roll R1.

Figure 14:
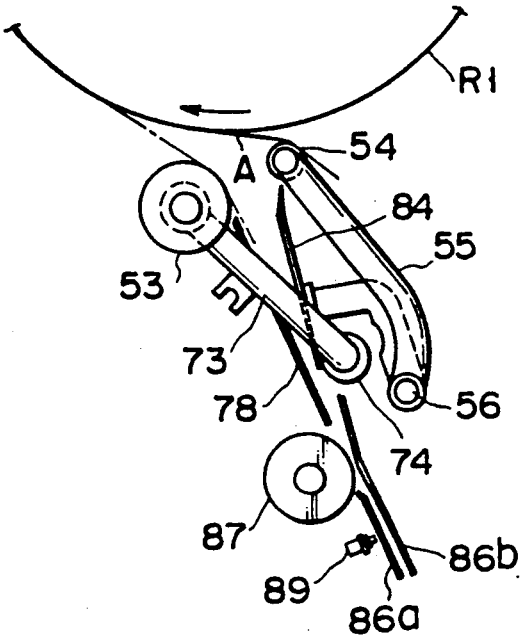

As described above, when the wrapping material A of the first roll R1 can be prepared to be unrolled, as shown in FIG. 14, the pinch feed rollers 54 are separated from the base feed roller 53, and the tension levers 73 and the guide plates 78 and 84 are located at illustrated positions. More specifically, the unrolling path of the wrapping material A defined between the guide plates 78 and 84 is opened so that the upper end portions of the guide plates are spread.

Figure 15:
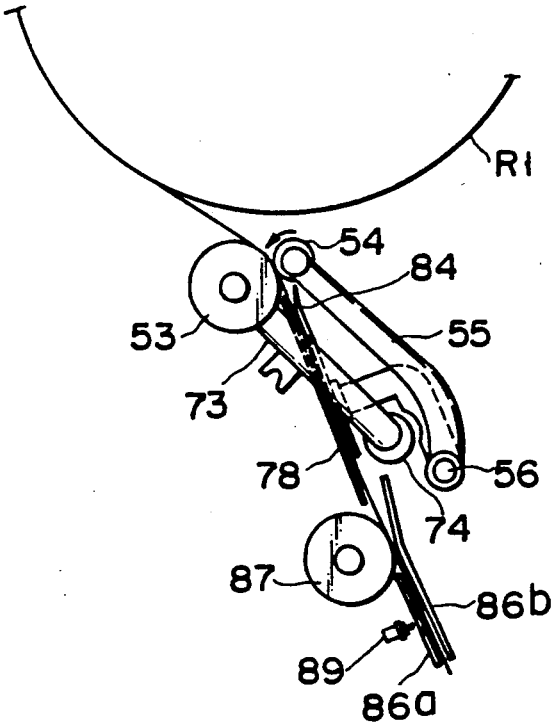

In this state, when the first roll R1 is rotated in a direction of an arrow in FIG. 14 at a predetermined rotational angle, the leading end portion of the wrapping material A clears the pinch feed rollers 54, and is then guided between the guide plates 78 and 84. Thereafter, the guide plate 84 is pivoted toward the guide plate 78 and is located to extend parallel to the guide plate 78. At the same time, the pinch feed rollers 54 are brought into rolling contact with the base feed roller 53, as shown in FIG. 15 to clamp the leading end portion of the wrapping material A, and receive the driving force from the base feed roller 53 to be rotated in a direction of an arrow in FIG. 15. Thus, the wrapping material A is unrolled from the first roll R1 to a gap between the guide plates 86*a* and 86*b* while passing between the guide plates 78 and 84 beyond the guide roller 87.

When the leading end portion of the wrapping material A passes by a gap between the guide plates 78 and 84, since the pair of plate pieces 84*a* constituting the guide plate 84 are separated from each other, the adhesive tape B remaining at the center of the leading end portion of the wrapping material A will not adhere to the guide plate 84 to prevent an unrolling operation of the wrapping material A.

Figure 16:
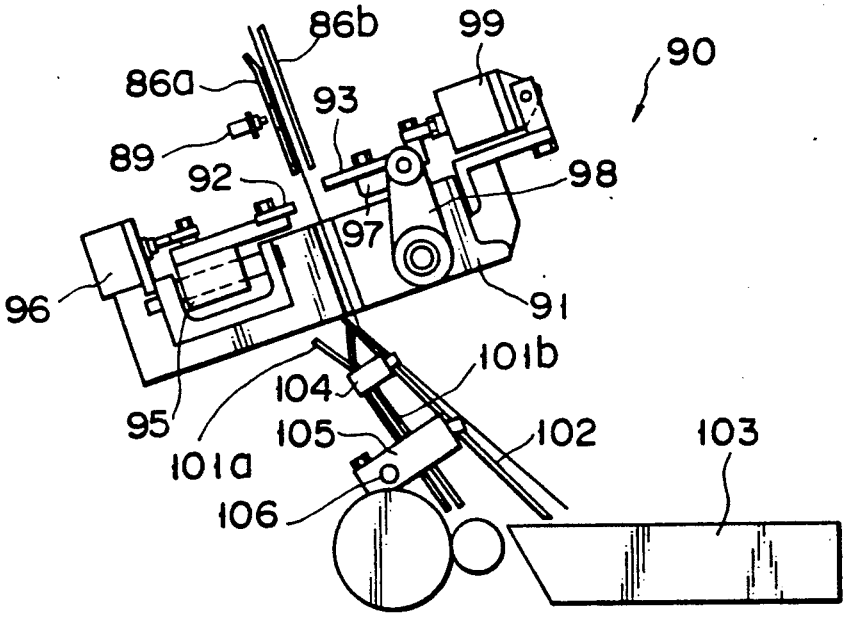

When the wrapping material A is unrolled, as described above, the movable cutting blades 92 and 93 of the cutter unit 90 are opened, as shown in FIG. 16, before the leading end of the wrapping material A reaches the cutter unit 90, and the guide plates 101*a* and 101*b*, and the exhaust guide 102 are inclined to be continuous with the path 100 of the cutter block 91.

When the wrapping material A begins to be unrolled in this state, the leading end portion of the wrapping material A passes through the path 100 of the cutter block 91 from a gap between the pair of guide plates 86*a* and 86*b*, and thereafter, can be guided by the exhaust guide 102.

When the wrapping material A is unrolled from the first roll R1 beyond the pair of movable cutting blades 92 and 93 by a predetermined length, the unrolling operation of the wrapping material A is interrupted. More specifically, in this embodiment, when the sensor 89 arranged on the side of the guide plate 86*a* detects passage of two register marks M formed on the wrapping material A, the unrolling operation of the wrapping material A by the pinch feed rollers 54 is stopped. The unrolling operation of the wrapping material A by the pinch feed rollers 54 is stopped by stopping a driving motor (not shown).

When the unrolling operation of the wrapping material A is stopped, the pair of movable cutting blades 92 and 93 of the cutter unit 90 are closed, and the wrapping material A is cut from a predetermined position, thereby forming a new leading end of the wrapping material A remaining on the side of the first roll R1. On the other hand, the adhesive tape B is kept adhered to the wrapping material piece cut in this manner, and is guided by the exhaust guide 102 to be recovered into the dust box 103.

Thereafter, the pair of guide plates 101*a* and 101*b* and the exhaust guide 102 are returned to pivot positions shown in FIG. 8.

After the leading end of the wrapping material A is formed by cutting in this manner, the wrapping material A of the first roll R1 passes through a gap between the pair of guide plates 101*a* and 101*b* to be further unrolled and conveyed. On the downstream side of the above-mentioned cutting/unrolling unit 39, the wrapping material A is guided along a convey path 109 which can be connected to the guide plates 101*a* and 101*b*. The convey path 109 can have various arrangements, and does not constitute a portion of the present invention. Thus, the convey path 109 is only schematically illustrated in FIG. 8, and its description will be omitted.

As described above according to the leading end unrolling/cutting device for a strip-like material of the present invention, since the chuck head provided with the stationary and movable chuck pawls is vertically moved through the parallel link mechanism, when the stationary chuck pawl is brought into contact with the outer peripheral surface of a roll, the distal end of the stationary chuck pawl can be prevented from projecting into the outer peripheral surface of the roll, and the outer peripheral surface of the roll can be prevented from being damaged by the stationary chuck pawl.

The leading portion of a strip-like material which is peeled from the roll as a free end can be reliably guided and clamped between the base and pinch feed rollers since the pinch feed roller is in rolling contact with the base feed roller to approach/separate from it, i.e., to be openable/closable. In addition, the unrolling operation of the following strip-like material can be facilitated by these base and pinch feed rollers.

Furthermore, the pinch feed roller can be located at both the open and close positions and is a driving roller, and the base feed roller is a driven roller. Therefore, when the strip-like material from the roll is unrolled by a feed roller and the like in the next process, the pinch feed roller is located at the open position. Then, a travel resistance of the strip-like material can be reduced when the strip-like material travel between the base and pinch feed roller.

Additional advantages and modifications will readily occur to those skilled in the art. Therefore, the invention in its broader aspects is not limited to the specific details, representative devices, and illustrated examples shown and described. Accordingly, various modifications may be made without departing from the spirit or scope of the general inventive concept as defined by the appended claims and their equivalents.

What is claimed is:

1. A device including a base frame for unrolling a leading end portion of a strip-like material from a roll formed by winding the strip-like material on a loading shaft projecting horizontally from the base frame, and cutting the leading end portion of the strip-like material, the device further comprising:

a chuck head comprising a horizontal stationary chuck pawl, and a movable chuck pawl which can approach/separate from said stationary chuck pawl;

a parallel link mechanism for supporting said chuck head to be vertically movable while keeping a horizontal position thereof;

a lift mechanism for vertically moving said chuck head;

a base feed roller and a pinch feed roller, said pinch roller being able to approach/separate from said base feed roller, and said base and pinch feed rollers being arranged below the roll loaded on said loading shaft;

an opening/closing mechanism for causing said pinch feed roller to approach/separate from said base feed roller;

roll-driving means for rotating the roll forward and backward, said roll-driving means rotating the roll in a direction opposite to a direction in which the strip-like material is wound around the roll when said chuck head peels the leading end portion of the strip-like material off the periphery of the roll, and said roll-driving means rotating the roll in the same direction as the direction in which the strip-like material is wound around the roll when the leading end portion of the strip-like material peeled off by said chuck head is guided between said base feed roller and said pinch feed roller;

guide means for guiding the strip-like material fed by said base and pinch feed rollers along a predetermined path;

a cutter unit, arranged midway along a path along which the strip-like material is conveyed, for cutting the strip-like material;

an exhaust guide for guiding an unnecessary portion of the leading end portion of the cut strip-like material; and guide switching means for guiding the unnecessary portion before a cut position of the strip-like material to said exhaust guide, and guiding the strip-like material after the cut position to a leading end guide.

2. A device according to claim 1, wherein said base feed roller is rotated by driving means, and said pinch feed roller is rotatably supported.

3. A device according to claim 1, which further comprises a first detector mounted on at least one of said stationary and movable chuck pawls, and a second detector arranged midway along the convey path along which the strip-like material is conveyed, wherein said first detector detects that the leading end portion of the strip-like material is inserted between said stationary and movable chuck pawls to control an opening/closing operation of said stationary and movable chuck pawls, and said second detector detects the leading end portion of the strip-like material fed along the convey path to control an operation of said cutter unit.

4. A device including a base frame for unrolling a leading end portion of a strip-like material from a roll formed by winding the strip-like material on a loading shaft projecting horizontally from the base frame, and cutting the leading end portion of the strip-like material, the device further comprising:

a chuck head comprising a horizontal stationary chuck pawl, and a movable chuck pawl which can approach/separate from said stationary chuck pawl;

a parallel link mechanism for supporting said chuck head to be vertically movable while keeping a horizontal position thereof;

a lift mechanism for vertically moving said chuck head;

a base feed roller and a pinch feed roller, said pinch roller being able to approach/separate from said base feed roller, and said base and pinch feed rollers being arranged below the roll loaded on said loading shaft;

an opening/closing mechanism for causing said pinch feed roller to approach/separate form said base feed roller; and roll-driving means for rotating the roll forward and backward, said roll-driving means rotating the roll in a direction opposite to a direction in which the strip-like material is wound around the roll when said chuck head peels the leading end portion of the strip-like material off the periphery of the roll, and said roll-driving means rotating the roll in the same direction as the direction in which the strip-like material is wound around the roll when the leading end portion of the strip-like material peeled off by said chuck head is guided between said base feed roller and said pinch feed roller.

* * * * *